US009242258B2

(12) United States Patent
Brekenfeld et al.

(10) Patent No.: US 9,242,258 B2
(45) Date of Patent: Jan. 26, 2016

(54) MULTI-NOZZLE CHIP FOR ELECTROSPRAY IONIZATION IN MASS SPECTROMETERS

(71) Applicant: Bruker Daltonik GmbH, Bremen (DE)

(72) Inventors: Andreas Brekenfeld, Bremen (DE); Ralf Hartmer, Hamburg (DE)

( * ) Notice: Subject to any disclaimer, the term of this patent is extended or adjusted under 35 U.S.C. 154(b) by 21 days.

(21) Appl. No.: 14/218,034

(22) Filed: Mar. 18, 2014

(65) Prior Publication Data

US 2014/0284406 A1 Sep. 25, 2014

(30) Foreign Application Priority Data

Mar. 21, 2013 (DE) ..... 10 2013 004 871

(51) Int. Cl.

| | |
|---|---|
| ***B05B 5/00*** | (2006.01) |
| ***B05B 5/025*** | (2006.01) |
| ***H01J 49/26*** | (2006.01) |
| ***H01J 49/00*** | (2006.01) |
| ***H01J 49/16*** | (2006.01) |

(52) U.S. Cl.

CPC ..... *B05B 5/0255* (2013.01); *H01J 49/0018* (2013.01); *H01J 49/165* (2013.01); *H01J 49/26* (2013.01)

(58) Field of Classification Search

CPC ..... B05B 5/03; B05B 5/0533; B05B 17/04; B03C 3/16

USPC ..... 239/696, 705, 706, 707, 548, 566

See application file for complete search history.

(56) References Cited

U.S. PATENT DOCUMENTS

| | | | | |
|---|---|---|---|---|
| 3,870,232 | A * | 3/1975 | Lacchia | 239/696 |
| 7,360,724 | B2 * | 4/2008 | Willey et al. | 239/707 |
| 2009/0056133 | A1 | 3/2009 | Waits et al. | |
| 2009/0261244 | A1 | 10/2009 | Syms | |
| 2011/0147576 | A1 | 6/2011 | Wouters et al. | |
| 2011/0192968 | A1 | 8/2011 | Makarov et al. | |
| 2012/0217389 | A1 | 8/2012 | Zheng et al. | |

FOREIGN PATENT DOCUMENTS

| | | | |
|---|---|---|---|
| GB | 2471520 | B2 | 1/2011 |
| WO | 2009023257 | A1 | 2/2009 |
| WO | 2010112820 | A1 | 10/2010 |

* cited by examiner

*Primary Examiner* — Davis Hwu
(74) *Attorney, Agent, or Firm* — Benoit & Cote, Inc.

(57) ABSTRACT

The invention involves electrospray ionization of dissolved substances at atmospheric pressure in the ion source of a mass spectrometer. A chip with a multitude of spray nozzles is proposed, where each individual spray nozzle is surrounded by several sheath gas nozzles, preferably in a symmetric arrangement, for the jet-like introduction of a sheath gas. A shared attracting-voltage electrode is positioned substantially opposite the spray nozzles. The attracting-voltage electrode may have a tapering (e.g. funnel-shaped) opening above each spray nozzle so that the sheath gas jets are forced to closely envelop the spray jet, which is comprised of ions and very fine droplets. Heavier ions and droplets are thus prevented from discharging on the surfaces of the openings of the attracting-voltage electrode. Special measures can be taken to make all spray nozzles spray uniformly and to supply them with substance peaks from chromatographic or electrophoretic separators as simultaneously as possible.

17 Claims, 5 Drawing Sheets

MULTI-NOZZLE CHIP FOR ELECTROSPRAY IONIZATION IN MASS SPECTROMETERS

BACKGROUND OF THE INVENTION

1. Field of the Invention

The invention relates to electrospray ionization of dissolved substances at atmospheric pressure in the ion source of a mass spectrometer.

2. Description of the Related Art

A "chip" here is defined as a miniaturized device produced by microsystem engineering and usually having several permanently bonded layers of semiconductor materials, glasses, ceramics, metals or plastic materials. A multi-nozzle spray chip is a linear or two-dimensional arrangement of several miniaturized electrospray nozzles, spaced several hundred micrometers apart, with suitable feeds for the spray liquid and for auxiliary gases, and with suitable electrodes for the attracting and guiding voltages.

For a spray system with n nozzles operating in parallel, the ion current increases as $\sqrt{n}$ at a constant total flow rate, as is described in the publication "A Micro-Fabricated Linear Array of Electrospray Emitters for Thruster Applications" by L. F. Veláquez-Garcia et al., J. Micromech. Systems 15, pp. 1260-1271, 2006. Multi-nozzle systems are therefore a means to increase the total ion yield.

The document US 2011/0147576 A1 (E. R. Wouters et al.) can be considered to be the closest prior art. Here the spray nozzles of a chip are surrounded, either individually or all together, by a flow of sheath gas which envelops the jet of sprayed droplets. The chip does not have a permanently connected counterelectrode to generate the attracting field, nor does it have a special means of guiding the sheath gas beyond the tip of the spray nozzle. The document provides an in-depth discussion of the prior art.

In the publication "Integrated out-of-plane nanoelectrospray thruster arrays for spacecraft propulsion", R. Krpoun and H. R. Shea, J. Micromech. Microeng. 19 (2009), the spray nozzles are covered by a shared counterelectrode which has an individual opening for each spray nozzle. It does not have any sheath gas nozzles, however.

The document US 2012/0217389 A1 (Y. Zheng et al.) also describes a multi-nozzle system on a chip which has a permanently integrated counterelectrode with openings for each spray nozzle; but here too, no sheath gas flows are used.

The increase in the total ion yield as $\sqrt{n}$ stated above refers to the total number of ions produced, which is important for the jet engines used in space travel. For mass spectrometric applications, however, the only aspect of interest is increasing the yield of analyte ions from analyte molecules which are dissolved in the liquid. With so-called "nanospraying", this yield is almost 100 percent for those analyte molecules which can be protonated at all (cf. U.S. Pat. No. 5,504,329 A; M. Mann and M. Wilms, 1996). But for this nanospraying, the flow of spray liquid is limited to tiny flow rates of between 10 and 100 nanoliters per minute. If one succeeded in multiplying the nanospraying in a spray chip with n nozzles, and transferring the analyte ions produced into the vacuum with a high yield, in a similar way to nanospraying, it would be possible to obtain an n-fold number of analyte ions, with a likewise n times higher liquid flow.

In view of the foregoing, there is a need to provide a multi-nozzle system on a chip which allows all the nozzles to spray uniformly with the lowest possible ion losses. When connected to a chromatograph, it should, on the one hand, be possible to supply all the spray nozzles with the analyte molecules of a temporally short substance peak as simultaneously as possible and, on the other hand, "peak parking" should be possible. The objective is also to provide an arrangement which is adapted to the multi-nozzle system and which enables the ion current generated to be transferred into the vacuum system of a mass spectrometer with as few losses as possible.

SUMMARY OF THE INVENTION

A chip with a large number of spray nozzles is proposed, each individual spray nozzle being surrounded by sheath gas nozzles, preferably in a symmetric arrangement, for the jet-like feeding in of a sheath gas. The chip contains a shared attracting-voltage electrode which extends over all the spray nozzles. The attracting-voltage electrode may have a tapering (e.g. funnel-shaped) opening above each spray nozzle so that the jets of sheath gas are directed toward the spray jet in this opening and closely envelope the spray jet, which is comprised of ions and very fine droplets. Heavy ions and droplets are thus prevented from discharging on the surfaces of the attracting-voltage electrode. Special measures and means can be advantageously used to make all the spray nozzles spray uniformly and to supply them with substance peaks from chromatographic or electrophoretic separators as simultaneously as possible. The gas-guided ion currents of each individual spray nozzle can be optimally transferred into a first stage of a vacuum system by means of an integrated multichannel inlet plate.

In other words, the proposal here is to surround each spray nozzle of a multi-nozzle spray chip with gas nozzles for feeding in a sheath gas, and to place a shared attracting-voltage electrode opposite all the spray nozzles. This electrode may have a tapering (e.g. funnel-shaped) opening over each spray nozzle. The sheath gas nozzles can be nozzle-shaped (e.g. circular), or slit-shaped. They are preferably arranged symmetrically around the spray nozzle, and their exit apertures should be so small that the sheath gas is fed in as highly focused sheath gas jets. The jets of sheath gas are brought close together in the tapering openings above the spray nozzles and closely surround the respective spray jets, which are essentially composed of ions and very fine droplets. This largely prevents the ions and droplets of the spray jet from discharging on the inner surfaces of the openings in the attracting-voltage electrode; only very light ions, especially the vast quantities of water cluster ions are able, owing to their extremely high mobility, to pass through the sheath gas and reach the attracting-voltage electrode. For a field distribution which allows straight spraying into the center of the opening, it is advantageous for the opening of the attracting-voltage electrode to be centered (e.g. concentric) above the spray nozzle. It is therefore preferable for the base which holds the spray and sheath gas nozzles to be fixed to the attracting-voltage electrode, insulated and exactly positioned, so as to form a chip.

The liquid to be sprayed is preferably polar, as usual, and contains many positive and negative ions, mostly by acidification. It preferably consists of water with admixtures of organic solvents. The liquid from the spray nozzle is sprayed in a known way: the electric field forms a Taylor cone at the tip of the spray nozzle, and the highly charged surface liquid is drawn off from this tip in the form of a continuous jet of liquid; this jet breaks up into a series of tiny, highly charged droplets due to the surface tension and the high charge density on the surface, which both automatically enhance slight irregularities of the surface form, and due to the friction with the ambient gas. These droplets then dry in the ambient gas and leave behind mainly multiply charged ions of the analyte substances originally dissolved, in addition to large numbers of water cluster ions of the form $H_3O^+.(H_2O)_n$.

In order that all the spray nozzles spray uniformly, a pressing force for the liquid in conjunction with specially formed capillary resistances in the feeds to the individual spray nozzles can create a uniform supply of spray liquid. On the other hand, experiments show that uniform spraying can be achieved if the supply of liquid for each spray nozzle is self-regulating by means of capillary flow from a reservoir. Thirdly, the attracting-voltage electrode can be made of a high-resistance material: a high spray rate at one spray nozzle then causes large numbers of light ions with high mobility to flow onto the attracting-voltage electrode and reduce the attracting voltage there so that the spraying process is self-regulating.

The spray liquid can best be supplied by feeding a higher flow than is used by the spray nozzles past the feeds to the spray nozzles at a specified positive pressure, said feeds being kept short and low-volume. This means that the spray nozzles can be supplied reasonably simultaneously with the substance batches from chromatographic or electrophoretic separators. The higher the unused flow, the more concurrent will be the arrival times of the substance batches at the spray nozzles. On the other hand, such an arrangement allows so-called "peak parking", whereby a substance of a substance batch remains at the spray nozzles for a considerable period and can be sprayed for a considerable period by reducing the input flow rate. An ideal simultaneity for the arrival of a substance peak at all spray nozzles can be achieved by means of a supply arrangement where all supply paths to the spray nozzles are of equal length.

The gas-assisted plasma clouds carrying the ion currents which exit from the multi-nozzle system above each of the spray nozzles (e.g. in club shape) have a total dimension of several millimeters perpendicular to the flow direction. They can be transferred into the vacuum by a conventional inlet capillary which is widened in the form of a funnel. They can also be introduced into a first stage of a vacuum system through individual inlet channels which are each assigned to an individual spray nozzle. The inlet channels assigned to the spray nozzles can be contained in a compound plate of the multi-nozzle spray chip and can also feed in further drying gas for the final drying of the droplets. In the first stage of the vacuum system, they can be captured by an ion funnel, separated from the gas and fed to the mass analyzer. It is also possible, especially at high gas flows, to transfer them into a second stage of the vacuum system by means of a multichannel inlet system. Such a multichannel inlet system is described in document U.S. Pat. No. 7,462,822 B2 (C. Gebhardt et al., corresponding to GB 2 423 629 B and DE 10 2005 004 885 B4).

Both the sheath gas and a drying gas, which is additionally fed in through the introduction plate, can be heated to suitable temperatures in order to accelerate the drying process.

Figure 10:
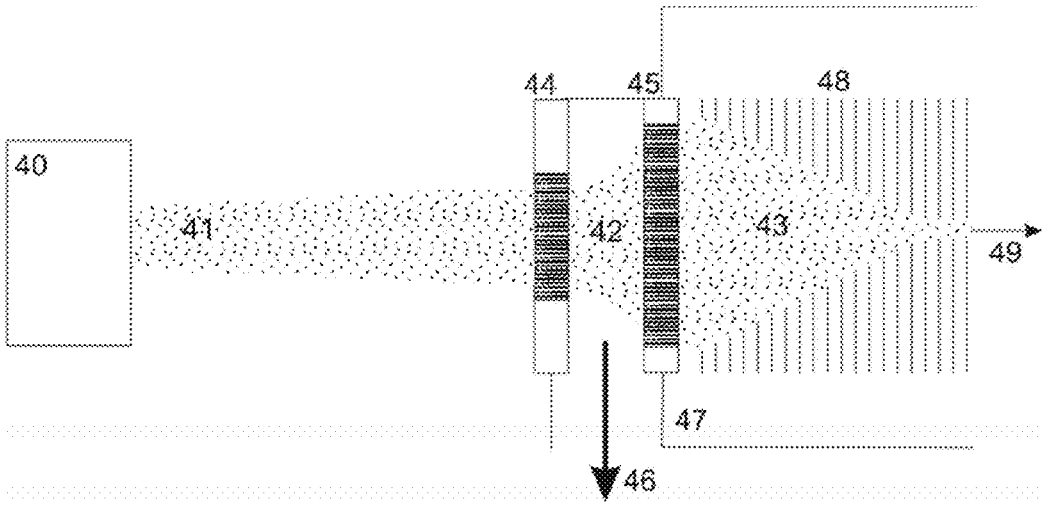

The schematic in FIG. 10 shows a different means of introducing ions into the vacuum system of a mass spectrometer. The ions produced in the multi-nozzle spray chip (40) form an ion beam which is only slightly divergent (41), and after a flight path of between a few millimeters and several centimeters, this beam impacts on the central area of a multichannel plate (44), where the ions of the beam (41) are drawn into and guided through the channels by the low pressure behind the multichannel plate (44) and by electric fields. A second multichannel plate (45) is located behind the multichannel plate (44); the space between the two plates is evacuated in the direction (46) by a powerful roughing pump. Around one tenth of the gas passes through the second multichannel plate (45) and entrains the ions (42) which are guided to the multichannel plate (45) by a voltage between the multichannel plates. The ions (43) are collected in the vacuum chamber (47) of the mass spectrometer by a conventional ion funnel (48) or other suitable ion guide and fed to the mass spectrometric measurement in direction (49).

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
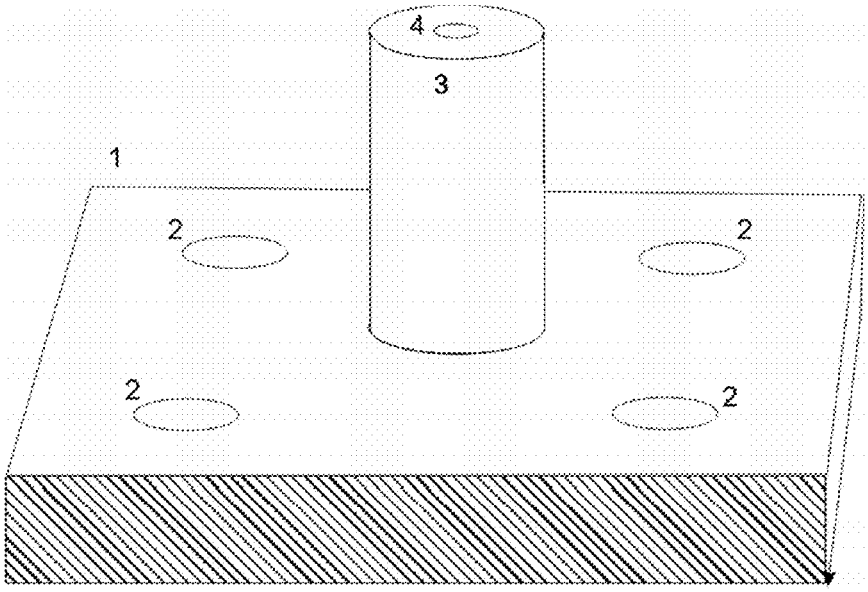
FIG. 1 depicts a spray nozzle (3) with a spray aperture (4) on a base substrate (1). The spray nozzle (3) in this example takes the form of a thick-walled hollow cylinder which projects from the base substrate (1) and is additionally surrounded by four gas nozzles (2), which are essentially formed by openings in the base substrate (1).
Figure 2:
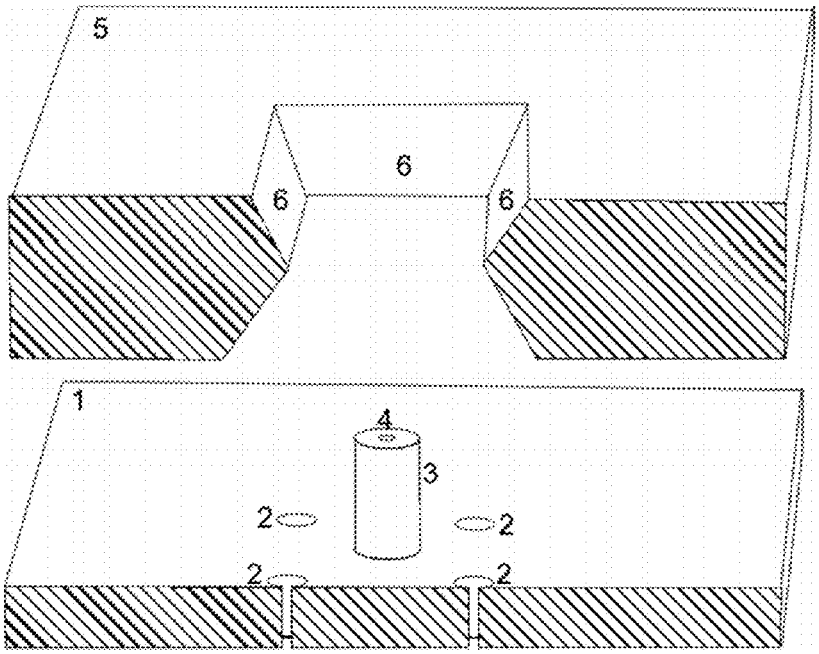
In FIG. 2, the spray nozzle arrangement according to FIG. 1 is opposite an attracting-voltage electrode (5), which is permanently fixed to the base substrate (1) via intermediate insulating materials (not shown in the drawing). The attracting-voltage electrode (5) has an opening in the shape of a double funnel with inner walls (6) which taper the gas flow from the gas nozzles (2) and thus prevent the ions and droplets of the spray jet from the spray aperture (4) from coming into contact with the inner walls (6). The double-funnel-shaped opening can be manufactured by erosive etching or ablation of a suitable crystalline structure.

The proposal here is to use a multi-nozzle spray chip in which each spray nozzle is surrounded by round or slit-shaped sheath gas nozzles, preferable four symmetrically arranged sheath gas nozzles, which feed in a sheath gas. It is possible to use 4 by 4, 6 by 6 or 8 by 8 spray nozzles, for example, which means that a fourfold, sixfold or even eightfold increase in the total ion yield, and possibly a 16-fold, 36-fold or 64-fold increase in the yield of analyte ions can be expected. The spray nozzles can also be arranged linearly instead of in a two-dimensional array, see FIG. 6. The spray nozzles preferably project from the base so that a high electric attracting field can form at their tip; this field then forms a Taylor cone of liquid, which in turn forms the spray jet, see FIGS. 1 to 4. As can be seen particularly well in FIG. 2, each spray nozzle is surrounded at the base by several, preferably four, fine sheath gas nozzles which produce the jets of sheath gas. The number of sheath gas nozzles per spray nozzle is not limited in principle, and there can be two, three, four, five, six, seven, eight, nine or more. The sheath gas nozzles are preferably arranged symmetrically around the spray nozzle; for example three sheath gas nozzles can be arranged on the circumference of a circle with an angular separation of around 120 degrees. Above the spray nozzles is a shared attracting-voltage electrode (5 in FIG. 2; 30 in FIG. 7, 38 in FIG. 9), which may have a tapering (e.g. funnel-shaped) aperture above each spray nozzle; this opening can also have the form of a double funnel (i.e. first narrowing and then widening out again). In these openings, the jets of sheath gas are guided to surround and focus the spray jets. Each spray jet consists of ions and highly charged, very fine droplets which repel each other and try to drive each other out of the spray jet in a radial direction. The funnel causes the sheath gas to closely envelop each individual spray jet; this means that heavy ions and droplets of the spray jet are prevented by their low mobility from penetrating through the sheath gas and discharging on the inner surfaces of the openings, although the attracting-voltage electrode attracts the charges of the droplets and the ions, in addition to their mutual space charge repulsion.

The drying process of the droplets is very complicated; the increasing charge density on the surface of the shrinking droplets repeatedly causes the droplets to become constricted and divide, but also directly expulses light ions, mainly charged water clusters. The droplets cool due to the loss of heat of vaporization; they can even freeze, in the limiting case. The sheath gas should therefore preferably be heated in order to accelerate the drying process of the droplets. The temperature here must be chosen so that, on the one hand, the droplets dry rapidly, but on the other hand the analyte ions are not destroyed, and consideration must be given to the fact that the drying process cools the analyte ions and thus protects them. It is quite possible to use temperatures of over one hundred degrees Celsius. Highly focused and hot jets of sheath gas also support the spraying process: they lead to the formation of mainly very small droplets.

The ions produced are transported through the openings in the attracting-voltage electrode by the sheath gas. An exception is the light water-cluster ions, for example $H_3O^+$ or $H_5O_2^+$, which are produced in large quantities and released as the droplets dry. The high mobility of these ions means they can penetrate the sheath gas and reach the attracting-voltage electrode around the opening. Since the drying process of many droplets is usually not complete before they arrive at the constriction in the attracting-voltage electrode, the beam of ions will still contain many light ions in the space above the attracting-voltage electrode.

In practice it is difficult to work with a large number of spray nozzles because slight disturbances to the flow or the attracting voltage, irregularities when coating the spray tip surface with liquid, and many other phenomena make it difficult for all the spray nozzles to spray uniformly. Special measures can be taken so that all the spray nozzles spray uniformly. A pressing force for the liquid in conjunction with specially formed capillary resistances in the feeds to the individual spray nozzles can create a uniform supply of spray liquid. On the other hand, experiments show that uniform spraying can be achieved if the supply of liquid for each spray nozzle is self-regulating by means of capillary flow from a reservoir. The reservoir can preferably consist of a network of suitably dimensioned lines, such as pipelines or tubes, which lead past the bases of the spray nozzles, as is shown schematically in FIG. 5. Thirdly, the attracting-voltage electrode can be made of a high-resistance material: if the spraying rate at a spray nozzle is too high, large numbers of light ions with high mobility will flow onto the attracting-voltage electrode and reduce the attracting voltage there so that the spraying process is self-regulating.

The jets of sheath gas are also important for all the spray nozzles to operate uniformly, however. When electrospray apparatus is actually in operation, the flow of liquid can be briefly disturbed, because of small gas bubbles, for example, and this can lead to a much higher flow rate for a short time, and also a brief interruption of the flow. If the spraying is interrupted, spray liquid can flow out of the nozzles. In this situation also, the design with jets of sheath gas which are assigned to each individual nozzle, as described here, represents a significant advantage: the wetted areas are efficiently blown free by the jets of sheath gas, so the attracting voltage is available again in a very short time and an orderly spraying operation is resumed without external intervention. The system can be self-healing in this respect.

Figure 7:
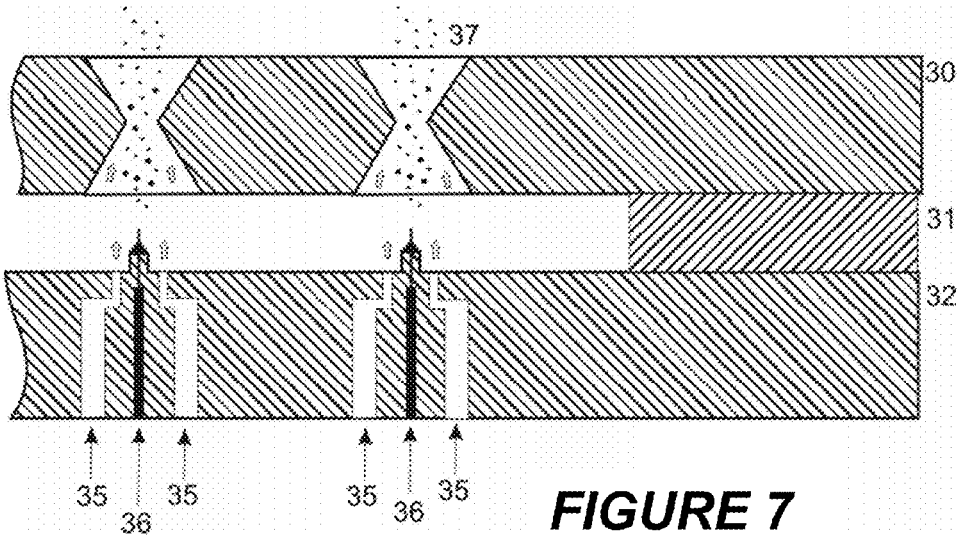
FIG. 7 is a schematic of a cross-section through part of a multi-nozzle spray chip. The attracting-voltage electrode (30) is connected via an insulator (31) with the base part (32) containing the spray nozzles. The sheath gas is fed in via the channels (35), the spray liquid via the channels (36). The sheath gas carries the spray jet (37), comprising spray droplets and ions, through the double-funnel-shaped opening in the attracting-voltage electrode (30). In this example, the shape of the opening in the attracting-voltage electrode (30) has a cross-section which resembles an hourglass, where an initially wide opening tapers to a point of smallest dimension before widening out again.

In particular, it is advantageous to keep the electric field distribution at every nozzle identical and symmetrical in order to enable straight spraying into the center of the opening. For such a field distribution it is favorable for every opening in the attracting-voltage electrode to be located precisely and symmetrically above a spray nozzle. It is difficult to adjust individual components with respect to each other, however, and it is therefore preferable for the base (32) which holds the spray and sheath gas nozzles to be fixed to the attracting-voltage electrode (30) via an insulating intermediate piece (31) so as to be exactly positioned, as can be seen in FIG. 7.

Figure 4:
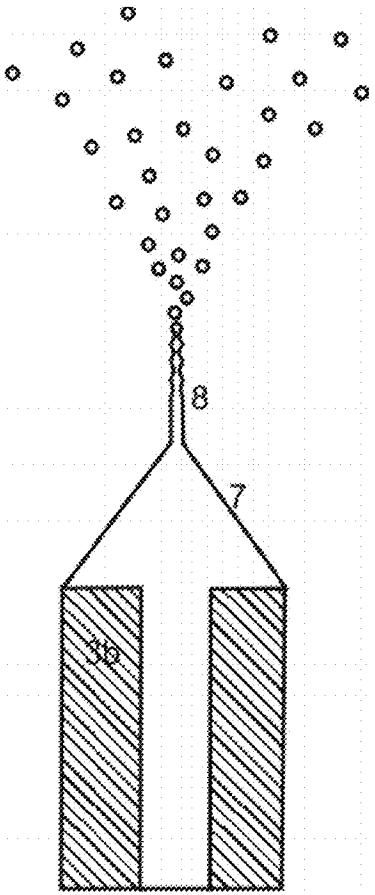
FIG. 4 depicts the operation of a spray nozzle (3*b*) whose surface around the spray aperture is strongly hydrophilic, so the liquid is able spread over this surface. The effect is essentially the same as in FIG. 3.
Figure 3:
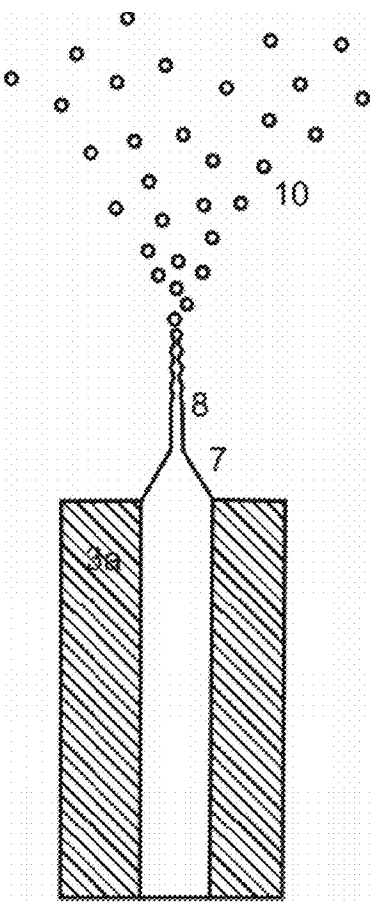
FIG. 3 shows how, during a spraying process, a Taylor cone (7), from whose tip a continuous jet of liquid (8) is extracted, forms in the aperture of the spray nozzle (3*a*) above the original liquid surface. The highly charged jet of liquid (8) rapidly becomes unstable as a result of initial irregularities caused by the surface tension and as a result of friction with the ambient gas (9). It disintegrates into a cloud (10) of tiny droplets, each highly charged, whose charges cause them to repel each other so that the cloud (10) expands greatly.

As is schematically shown in FIGS. 3 and 4, the liquid is sprayed from the spray nozzles in a usual way: the electric field formed by the voltage applied to the attracting-voltage electrode (not shown) forms a Taylor cone (7) in the liquid at the tip of the spray nozzle, and the charged liquid is extracted from this tip in an initially continuous spray jet (8). Self-reinforcing irregularities in the surface of the jet of liquid cause the spray jet to break up into a cloud (10) of tiny, highly charged droplets, which then dry in the ambient gas and leave behind ions of the analyte substances. The friction with the ambient gas helps to keep the droplets very small as they form. This process is therefore positively supported by the jets of sheath gas, especially by hot jets of sheath gas.

A Taylor cone always forms the same angle at the tip. FIGS. 3 and 4 show that the base of the Taylor cone which forms on the surface of the spray nozzle can be wide or narrow, depending on the shape and hydrophilicity of the spray nozzle's surface around the spray aperture. However, this has only a minor effect on the spraying process as long as the wetting remains stable. Here also, the jets of sheath gas help to keep the wetting stable. Broad wetting can make it more difficult for the Taylor cone to form and thus the spraying to start.

Figure 5:
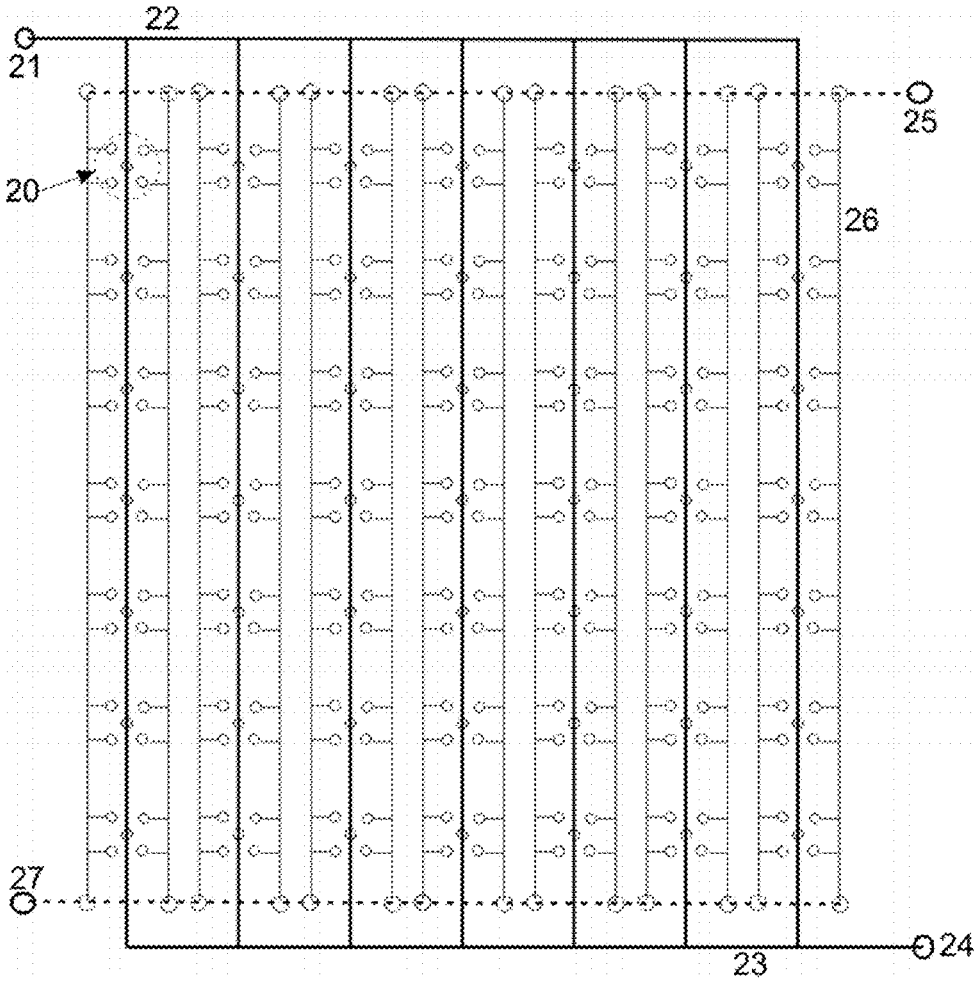
FIG. 5 is a schematic representation of the supply arrangement of a multi-nozzle spray chip with 7 by 7 groups (20), each comprising one central spray nozzle and four sheath gas nozzles connected to the spray liquid supply system (21, 22, 23, 24) and the sheath gas supply system (25, 26, 27) respectively.

The liquid can be supplied by feeding a higher flow than is used by the spray nozzles through the network of lines (21, 22, 23, 24), such as pipelines or tubes, in FIG. 5, at a specified positive pressure, and past the short feeds to the spray nozzles. This means that the spray nozzles can also be supplied reasonably simultaneously with the substance batches from chromatographs (or from electrophoretic separators). The higher the unused flow, the closer together the arrival times of the substance batches at the spray nozzles will become. On the other hand, such an arrangement allows so-called "peak parking", where a substance of a substance batch which is in the network of lines can be sprayed for a considerable period by reducing the input flow rate or even stopping the flow completely. In general, a substance batch from a liquid chromatograph has a length of between a few centimeters and a few tens of centimeters in the flowing liquid.

Figure 6:
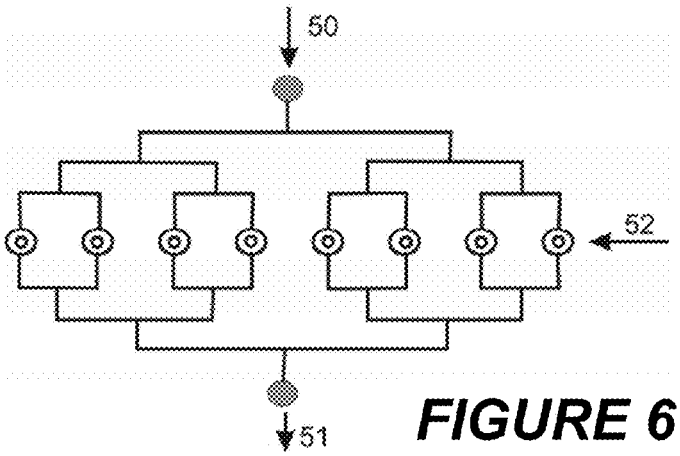
FIG. 6 shows eight linearly arranged spray nozzles (52) with supply lines which are of equal length from the introduction (50) to the spray nozzles (52) so that a chromatographic substance peak will arrive at all the spray nozzles (52) at the same time. The drains of the unused spray liquid also have equal path lengths to the outlet (51); it is thus possible to feed the liquid with a high chromatographic separation to further analytical apparatuses or detectors.

For nano-LC chromatographs, which provide only very short substance peaks, it may be necessary for the feed-in paths to the individual spray nozzles to be precisely the same length. FIG. 6 shows a way of producing paths to the spray nozzles of exactly the same length in a linear arrangement. It is also possible to keep the paths the same length in two-dimensional arrays of spray nozzles.

The gas clouds entraining the ions which exit from the multi-nozzle system above each spray nozzle (e.g. in club shape), and which have a total dimension of a few millimeters perpendicular to the flow direction, can be transferred into the vacuum system of a mass spectrometer with a conventional inlet capillary measuring 10 to 20 centimeters in length and with an inside diameter of around 0.5 millimeters. It can then be expedient to widen the inlet capillary in the form of a funnel at the front end. Such an inlet capillary can transport several liters of gas per minute into the vacuum; it is quite possible to dimension a multi-nozzle spray chip so that as much sheath gas is ejected as can be taken up by the inlet capillary. However, this type of ion introduction into the mass spectrometer means that the total flow of the sheath gas jet is limited to a few liters per minute. For a single capillary, there are also limits to the quantity of ions which can be introduced into the vacuum.

Figure 8:
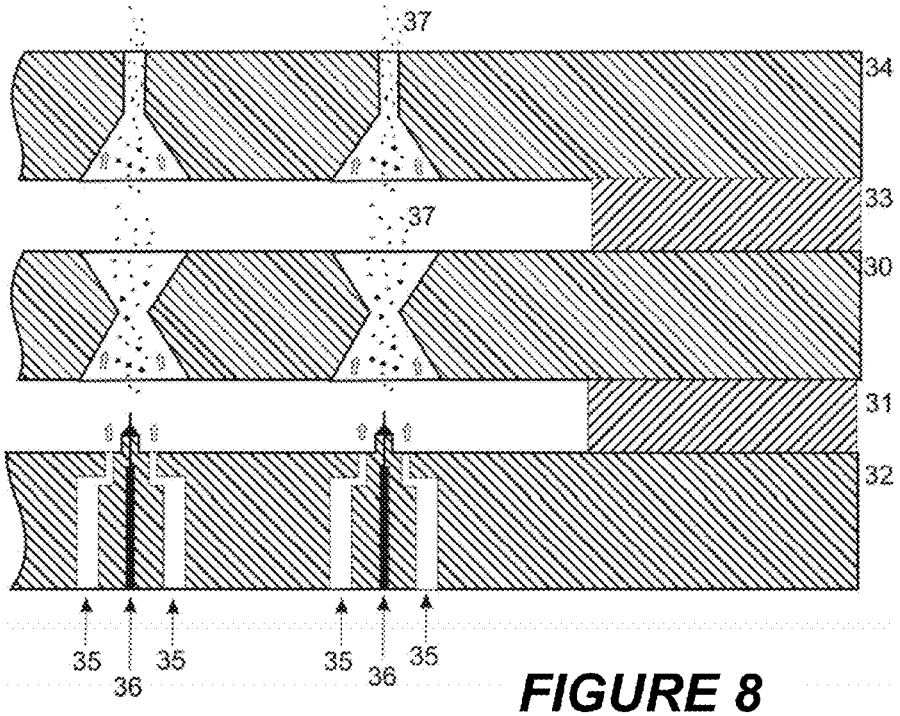
FIG. 8 shows how the spray jets (37) can be introduced directly into a first stage of a vacuum system through an integrated introduction plate (34) with fine channels. If the multichannel introduction plate (34) is manufactured from high-resistance material and has a conductive coating on its top and bottom surfaces, the ions in the tiny channels can also be guided electrically.

It can therefore be expedient to use other types of ion introduction. For example, as shown in FIG. 8, it is possible to use an inlet plate (34), also produced by microsystem engineering, which has precisely one small inlet channel for each spray nozzle and guides the ion currents (37) with their sheath gas flows into a first stage of the vacuum system. With 36 spray nozzles and hence 36 inlet capillaries with a diameter of around 30 micrometers and a length of 100 micrometers, no more gas is introduced into the vacuum than with a conventional inlet capillary. The channels can be drilled with laser beams or electron beams or conventional semiconductor machining techniques, for example; the drilling technique determines the minimum diameter and maximum length. The inlet plate (34) here can again be permanently connected to the multi-nozzle spray chip via an intermediate insulator (33) so as to be well aligned. The low pressure in the first vacuum stage draws in the flows of sheath gas and ions. If the total gas flow into this first stage of the vacuum system is small enough, a conventional RF ion funnel in this vacuum stage can separate the ions from the gas and transport them to the mass analyzer. It is even possible to design the inlet device (34) in such a way that further gas for the final drying of the droplets is fed in around each inlet channel. It is advantageous to heat this drying gas also. The inflow into the vacuum initially cools the gas flowing in adiabatically, but the subsequent turbulence causes a reheating.

If the gas flow into the first stage of the vacuum system is greater than a specific flow threshold, a pressure forms here which prevents the use of the RF ion funnel. An RF ion funnel can only be used in gases up to a pressure of about ten hectopascal. However, at higher pressures, the ions can be transferred from this first vacuum stage into a second vacuum stage via a multichannel introduction system, with the aid of electric fields if necessary. Such a multichannel inlet system is described in document U.S. Pat. No. 7,462,822 B2 (C. Gebhardt et al., corresponding to GB 2 423 629 B and DE 10 2005 004 885 B4). The ions are then collected by an RF ion funnel in this second vacuum stage and forwarded.

Figure 9:
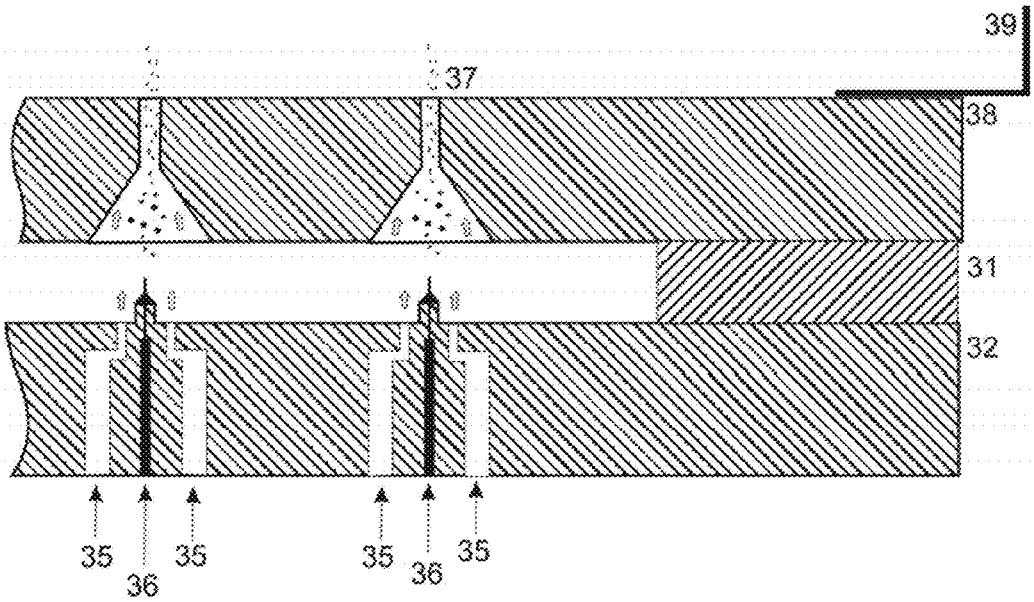
FIG. 9 illustrates the design of a simplified multi-nozzle spray chip where a modified attracting-voltage electrode (38) guides the ions through tiny cylindrical channels directly into a first stage of a vacuum system. The wall (39) is a schematic representation of the vacuum system.

If one succeeds in producing very small droplets in a multi-nozzle spray chip and drying them with the sheath gas over a very short path, then it is possible to use a greatly simplified multi-nozzle spray chip according to FIG. 9, whose modified attracting-voltage electrode (38) guides the ions directly through small channels into the first stage of the vacuum system. FIG. 9 is a particularly clear illustration of an example of a funnel-shaped opening (cross section).

A further type of ion introduction is shown in FIG. 10. The ions produced in the multi-nozzle spray chip (40) are largely kept together by the sheath gas flows and form an ion current which diverges only slightly (41). After a flight path of between a few millimeters and several centimeters, whose purpose is to dry all the droplets completely, this ion current (41) arrives in the central region of a multichannel plate (44), behind which is a low pressure region created by evacuating (46) with a powerful roughing pump. This means that the ions of the beam (41) are drawn through the multichannel plate (44) together with the sheath gas and guided through the fine channels with the aid of electric fields. Behind the multichannel plate (44) is a second multichannel plate (45), whose fine channels in the central region lead into the vacuum system of the mass spectrometer. A voltage between the two multichannel plates pushes the ions (42) to the multichannel plate (45). Around one tenth of the gas passes through the second multichannel plate (45) and entrains the ions (42). In the vacuum chamber (47) of the mass spectrometer, the ions (43) are collected by a conventional RF ion funnel (48), or other suitable ion guide, and fed to a mass spectrometric measurement in direction (49).

Conventional multichannel plates, as used in secondary electron multipliers, can be used here. These have a coating on their front and back which is a good conductor and can be supplied with voltages. The inner walls of each channel have a high-resistance coating and produce a linear voltage drop.

The ions are entrained by the flowing gas in the channels and their finite mobility means they can even be transported against a voltage of a few tens to a hundred volts. The voltage here can be set in such a way that very light ions, for example $H^+$, $H_3O^+$, $H_5O_2^+$ and similar, which are not interesting for the analysis and have an interfering effect, are held back due to their very good mobility and discharge on the inner walls of the channels. Heavy ions, in contrast, are fed through the channels with an astonishingly high yield.

In a simpler embodiment of the system for introducing ions into the vacuum system of a mass spectrometer, the introduction system consists of only one multichannel plate, which leads directly into the vacuum chamber with the RF ion funnel.

The invention has been described with reference to different embodiments thereof. It will be understood, however, that various aspects or details of the invention may be changed, or that different aspects disclosed in conjunction with different embodiments of the invention may be readily combined if practicable, without departing from the scope of the invention. Furthermore, the foregoing description is for the purpose of illustration only, and not for the purpose of limiting the invention, which is defined solely by the appended claims.

What is claimed is:

1. A multi-nozzle spray chip for electrospray ionization of analyte molecules which are dissolved in a liquid, wherein each spray nozzle is surrounded by a multitude of sheath gas nozzles ejecting sheath gas, comprising an attracting-voltage electrode which is located substantially opposite, and shared by, all the spray nozzles and has one opening of a plurality of openings substantially opposite each spray nozzle, and wherein each opening of the plurality of openings is configured such as to shape a sheath gas flow of the associated multitude of sheath gas nozzles to closely envelop droplets and ions of a spray jet generated by the associated spray nozzle.

2. The multi-nozzle spray chip according to claim 1, wherein each opening of the plurality of openings tapers to a point of smallest width.

3. The multi-nozzle spray chip according to claim 2, wherein each opening of the plurality of openings has a shape of one of a funnel and an hourglass.

4. The multi-nozzle spray chip according to claim 1, wherein the spray nozzles stand out from a chip base, and the chip base and the attracting-voltage electrode are connected to each other via an insulating intermediate piece.

5. The multi-nozzle spray chip according to claim 1, wherein a uniform spraying of all spray nozzles is achieved by one of (i) applying a pre-determined pressing force for a spray liquid in conjunction with specially formed capillary resistances in feeds to the individual spray nozzles, (ii) providing a supply of liquid for each spray nozzle in a self-regulating manner by means of capillary flow from a reservoir, and (iii) making the attracting-voltage electrode of a high-resistance material wherein a high spray rate at one spray nozzle causes large numbers of light ions with high mobility to flow onto the attracting-voltage electrode and reduce the attracting voltage there so that a spraying process is self-regulating.

6. The multi-nozzle spray chip according to claim 1, further comprising an introduction plate for the introduction of ions into a vacuum stage, the introduction plate having one introduction channel assigned to each spray nozzle.

7. The multi-nozzle spray chip according to claim 6, wherein the attracting-voltage electrode is used as introduction plate.

8. The multi-nozzle spray chip according to claim 6, further comprising means for feeding-in a drying gas through the introduction plate to assist in the evaporation of spray droplets.

9. The multi-nozzle spray chip according to claim 8, wherein the drying gas is heated.

10. The multi-nozzle spray chip according to claim 1, wherein feeding lines to the spray nozzles are dimensioned in such a way that a spray liquid takes the same period of time to reach all the spray nozzles.

11. The multi-nozzle spray chip according to claim 10, wherein all feeding lines to the spray nozzles have the same length.

12. The multi-nozzle spray chip according to claim 1, wherein more spray liquid is guided past feeding lines to the spray nozzles than is taken up by the spray nozzles.

13. The multi-nozzle spray chip according to claim 1, further comprising a mechanism which ensures that the supply of spray liquid essentially regulates itself through the uptake of a spraying process.

14. The multi-nozzle spray chip according to claim 1, further comprising a supply of substance peaks from a chromatographic or an electrophoretic separator.

15. The multi-nozzle spray chip according to claim 1, wherein each opening of the plurality of openings is substantially aligned concentric with the associated spray nozzle.

16. The multi-nozzle spray chip according to claim 1, wherein the spray nozzles are arranged one of linearly and in a two-dimensional array.

17. A system for introducing ions, which are produced in the multi-nozzle spray chip according to claim 1, into a vacuum system of a mass spectrometer, wherein the introduction system comprises at least one multichannel plate.

* * * * *